US005132488A

United States Patent [19]

Tessier et al.

[11] Patent Number: 5,132,488

[45] Date of Patent: Jul. 21, 1992

[54] ELECTRICAL TELECOMMUNICATIONS CABLE

[75] Inventors: Ronald Tessier, Montreal; Philip A. McGettigan, Lachine; Paul P. Kish, Dorval, all of Canada

[73] Assignee: Northern Telecom Limited, Montreal, Canada

[21] Appl. No.: 658,727

[22] Filed: Feb. 21, 1991

[51] Int. Cl.[5] ..... H01B 11/02

[52] U.S. Cl. ..... 174/34; 174/27; 174/113 R; 174/113 AS

[58] Field of Search ..... 174/27, 34, 113 R, 113 AS, 174/113 C, 117 AS, 131 R, 131 A

[56] References Cited

U.S. PATENT DOCUMENTS

| | | | |
|---|---|---|---|
| 1,008,370 | 11/1911 | Robillot | 174/113 R |
| 1,883,269 | 10/1932 | Yonkers | 174/27 |
| 3,644,659 | 2/1972 | Campbell | 174/27 |
| 3,678,177 | 7/1972 | Lawrenson | 174/113 O |
| 3,983,313 | 9/1976 | Ney et al. | 174/113 R |
| 4,654,476 | 3/1987 | Barnicol-Ottler | 174/116 |
| 4,777,325 | 10/1988 | Siwinski | 174/34 |
| 4,920,234 | 4/1990 | Lemke | 174/113 R |

FOREIGN PATENT DOCUMENTS

| | | | |
|---|---|---|---|
| 524452 | 5/1956 | Canada | 174/113 AS |
| 410640 | 4/1945 | Italy | 174/113 R |
| 422647 | 1/1935 | United Kingdom | 174/27 |
| 1280762 | 7/1972 | United Kingdom | 174/27 |

*Primary Examiner*—Morris H. Nimmo
*Attorney, Agent, or Firm*—R. J. Austin

[57] ABSTRACT

A telecommunication cable in which pairs of twisted together conductors are spaced apart to minimize capacitance unbalance and cross-talk. A central core member may be provided with the conductor pairs extending around the core member which may have spokes to separate the conductor pairs. Alternatively, the cable jacket has inwardly directed spacers which separate the conductor pins and hold them in recesses defined by the jacket.

5 Claims, 2 Drawing Sheets

ELECTRICAL TELECOMMUNICATIONS CABLE

BACKGROUND OF THE INVENTION

1. Field of the Invention

This invention relates to electrical telecommunications cable.

2. Description of Prior Art

Telecommunications cable is normally constructed with a core comprising one or more core units, each having a multiplicity of twisted units of conductors, each unit conventionally being a twisted pair of conductors. A core may be formed as a single core unit of twisted pairs. Care is taken, so far as is practicable, to ensure that pairs of equal or similar twist lays are separated from each other by other pairs. The reason for this arrangement is an attempt to maximize the communications performance of the cable, e.g. to lessen pair-to-pair capacitance unbalance, to reduce crosstalk between pairs, and to lower the coefficient of deviation of mutual capacitance of pairs in the cable. To reduce the pair-to-pair capacitance unbalance and to reduce cross-talk, suggestions have been made to move the conductor pairs relative to one another as they progress towards a stranding machine for stranding them into a core unit so that in the finished core unit, the conductor pairs change in relative positions and distances apart. In a suggested method for changing the relative positions of conductor pairs as they move towards the stranding machine, the conductor pairs enter a guide arrangement which comprises a system of horizontal guides movable horizontally and located in vertical tiered fashion. This method was first suggested by S. Norblad of Telefonaktiebolaget L. M. Ericsson, in a paper entitled "Capacitance Unbalance Telecommunications Networks" read before the International Wire and Cable Symposium in 1971. As a result of the use of this method, the conductor pairs obviously change positions and distances apart in the finished core and perhaps in a random manner.

SUMMARY OF THE INVENTION

The present invention seeks to provide an electrical telecommunications cable construction in which pair-to-pair capacitance unbalance and cross-talk is minimized in some other manner.

Accordingly, the present invention provides an electrical telecommunications cable comprising a plurality of pairs of individually insulated conductors, the conductors in each pair twisted together, and spacer means holding the pairs of conductors spaced apart.

The spacer means may be disposed along the axis of the cable or may be provided by inwardly extending projections of a jacket which surrounds the cable pairs.

When the spacer means is disposed along the axis of the cable, it may be a central core member of substantially circular shape. Alternatively, the central core member may be provided with radially outwardly extending projections which are spaced apart circumferentially of the core member and define recess regions between the projections. Each pair of conductors is disposed in an individual recess region and is separated from other pairs by the projections. In a further alternative arrangement, the spacer means comprises a plurality of spokes diverging radially outwards from the center to define recess regions for the conductors between the spokes.

Where the spacing means is provided by the projections extending inwardly from the jacket, then these projections are spaced circumferentially around the jacket to provide spacers and the pairs of conductors are separated from one another by the projections. In a practical manner of providing such a structure, the projections converge towards a common center and have spaced apart inner ends disposed outwardly of the center. Chambers are thus formed within the jacket and are defined partly by a circumferentially extending portion of the jacket and two projections positioned one at each end of the circumferentially extending portion.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
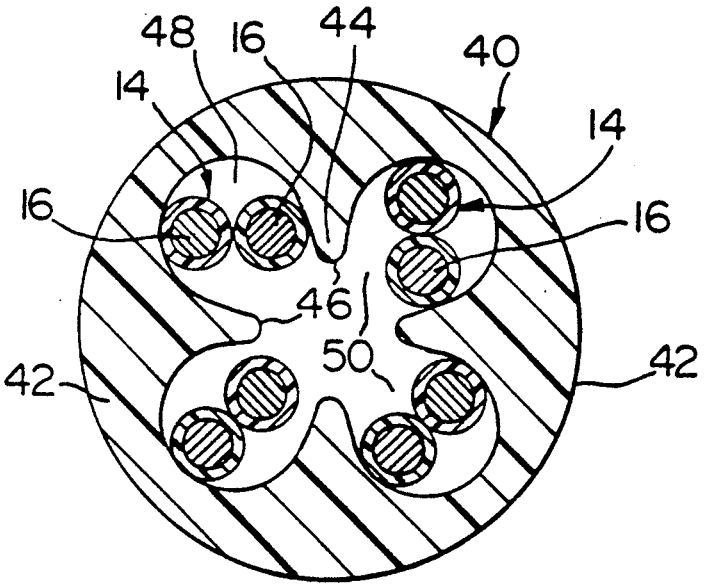
FIG. 1 is a lateral cross-sectional view through a cable according to a first embodiment.

In a first embodiment as shown by FIG. 1, an electrical telecommunications cable 40 comprises a jacket 42 of suitable polymeric material, the jacket surrounding four pairs 14 of individually insulated metal (i.e. copper) conductors 16. The conductors in each pair are twisted together in conventional manner. The jacket 42 incorporates spacer means for holding the pairs of conductors in spaced apart positions. The spacer means is provided by a plurality (namely four) of inwardly extending helically extending projections 44 spaced apart circumferentially around the jacket. These projections are integrally formed with the jacket during jacket extrusion and are equally angularly spaced apart around the axis of the jacket. The protrusions 44 are tapered radially to inner free ends 46 which are spaced outwardly from the axis of the jacket. This tapering is effected by concave surfaces which blend from one projection to another so as to define between adjacent projections recess regions 48 having smooth concave surfaces. The recess regions have openings 50 facing inwardly towards the axis of the jacket. Each pair 14 of conductors is housed within an individual recess 48, as shown, so that the distances between adjacent pairs is substantially constant along the length of the cable and with the distances between the pairs being substantially equal and maintained along the length of the cable. The spacing of the pairs minimize cross-talk between the pairs and in effect the voltage induced in the pairs is decreased. Dependent upon the performance requirements of the cable, the distances between the pairs can be determined for any particular AWG of conductor and mathematical modelling may be used to determine these required distances. Further, as may be seen from FIG. 1, in maintaining the distances between adjacent pairs substantially equal the induced voltages between the pairs is substantially the same. Hence, a degree of design control is provided for maintaining the distances between the conductor pairs constant along the length of the cable and as these distances are substantially equal from one pair to another, cross-talk between adjacent pairs is carefully controlled.

In other embodiments now to be described, features of the cable constructions which are similar to that of the first embodiment and/or to each other will bear the same reference numerals.

Figure 2:
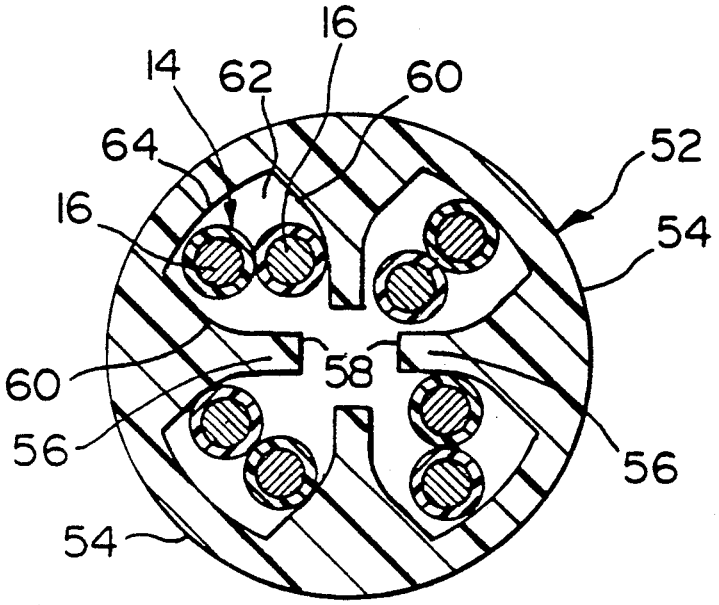
FIG. 2 is a view similar to FIG. 1 of a second embodiment.

In a second embodiment as shown by FIG. 2, a cable 52 has a jacket 54 also formed with radially inwardly extending and helically extending projections 56 of slightly different shape from those shown with regard to FIG. 1. In the case of the second embodiment the projections 56 extend with parallel sides radially outwards from their free ends 58 for a certain distance and then each of the projections increases in thickness with diverging flat surface areas 60. The surface areas 60 of adjacent projections 56 are substantially parallel on each side of a recess region or chamber 62 defined between the surface areas 60 and also by the inside surface 64 of a circumferentially extending portion of the jacket. Each recess region 62, which opens in a radially inward direction as described for the first embodiment above, houses an individual pair 14 of insulated conductors 16.

Figure 3:
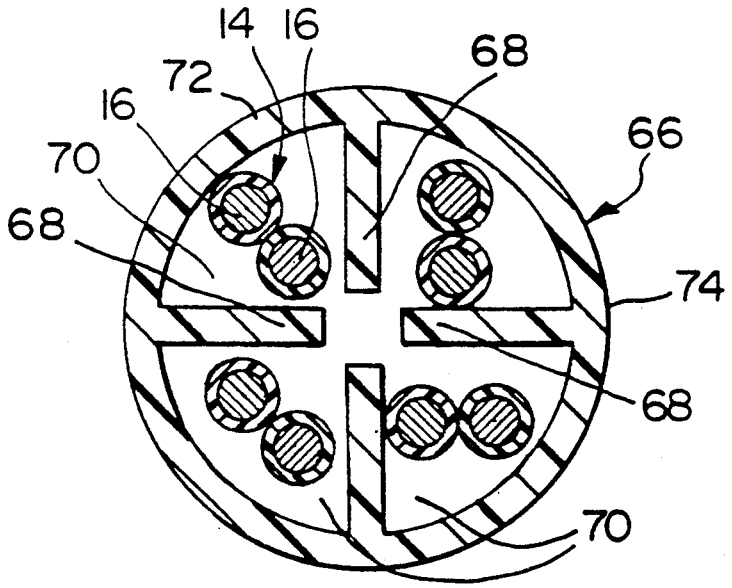
FIG. 3 is a view similar to FIG. 1 of a third embodiment.

In a third embodiment shown by FIG. 3, a cable 66 is of substantially the same structure as the cable 52. The cable 66 differs basically from cable 52 in that the projections 56 of changing thickness are omitted. Instead, the cable 66 has spacer means formed by four radially inwardly extending spokes 68 of constant thickness formed integrally with the jacket. Radially inwardly extending recess regions or chambers 70 housing individual conductor pairs 14 are defined between opposite spoke surfaces and relatively long circumferentially extending portions 72 of jacket 14.

In each of the embodiments described above, the pairs of conductors around the cable from pair-to-pair are maintained substantially equal distances apart with the distances between adjacent pairs maintained substantially constant along the length of the cable. This has the effect of minimizing cross-talk between pairs and permitting closeness between some of the pairs such as to detract from this minimized cross-talk capability.

What is claimed is:

1. An electrical telecommunications cable comprising a plurality of pairs of individually insulated conductors, the conductors in each pair twisted together, a cable jacket surrounding the plurality of pairs of conductors, the jacket formed with a plurality of inwardly extending projections spaced apart circumferentially around the jacket, the projections converging towards a common center and having spaced apart inner ends disposed outwardly of the common center to define recess regions within the jacket, each recess region by a circumferentially extending portion of the jacket and two projections, one at each end of the circumferentially extending portion, and each pair of conductors is contained within an individual recess region with the pairs of conductors spaced apart by the projections.

2. A cable according to claim 1 wherein the projections extend helically along the jacket.

3. A cable according to either claim 1 or claim 2 wherein each of the projections is tapered radially inwardly towards its inner end.

4. A cable according to claim 3 wherein a concave surface extends from one projection to another and defines an individual recess region.

5. A cable according to claim 3 wherein the projections are of constant thickness.

* * * * *